US006470879B1

(12) United States Patent
Taplan

(10) Patent No.: US 6,470,879 B1
(45) Date of Patent: Oct. 29, 2002

(54) COOKING APPARATUS WITH A GAS BURNER AND A DEVICE FOR HOLDING A COOKING VESSEL SUPPORT OVER THE GAS BURNER

(75) Inventor: Martin Taplan, Rheinboellen (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/855,263

(22) Filed: May 15, 2001

Related U.S. Application Data

(62) Division of application No. 09/460,694, filed on Dec. 14, 1999.

(30) Foreign Application Priority Data

Dec. 16, 1998 (DE) ..... 198 58 019
Feb. 11, 1999 (DE) ..... 199 05 670

(51) Int. Cl.[7] ..... F24C 15/10
(52) U.S. Cl. ..... 126/215; 248/346.01
(58) Field of Search ..... 126/39 B, 39 H, 126/211, 214 R, 215; 248/346.11, 346.5, 346.01

(56) References Cited

U.S. PATENT DOCUMENTS 2,485,145 A * 10/1949 Evans ..... 126/214 R
3,592,180 A * 7/1971 Kweller et al. ..... 126/214 R
5,931,152 A * 8/1999 Fafet et al. ..... 126/214 R

FOREIGN PATENT DOCUMENTS

DE 3003830 A1 * 8/1981
DE 8414673 U1 * 9/1984
WO WO 8905944 A1 * 6/1989
WO WO 9700407 A1 * 1/1997

* cited by examiner

*Primary Examiner*—Sara Clarke
(74) *Attorney, Agent, or Firm*—Michael J. Striker

(57) ABSTRACT

The cooking apparatus includes a glass-ceramic panel (1), which has at least one cooking area; a gas burner (3) providing an open flame (3); a cooking vessel support (5) including feet (5*b*) and a resting surface for a cooking vessel (6) placed on the cooking vessel support (5); and a device for holding the cooking vessel support (5) mechanically fixed and centered over the gas burner (3) including a foot holding device for holding the cooking vessel support (5). The foot holding device includes foot holders (7) for the respective feet, which are preferably formed by depressed or raised regions in the glass-ceramic panel or foot holder parts attached to it. The cooking apparatus of the invention is easier to clean and more economical than prior art cooking apparatus.

7 Claims, 4 Drawing Sheets

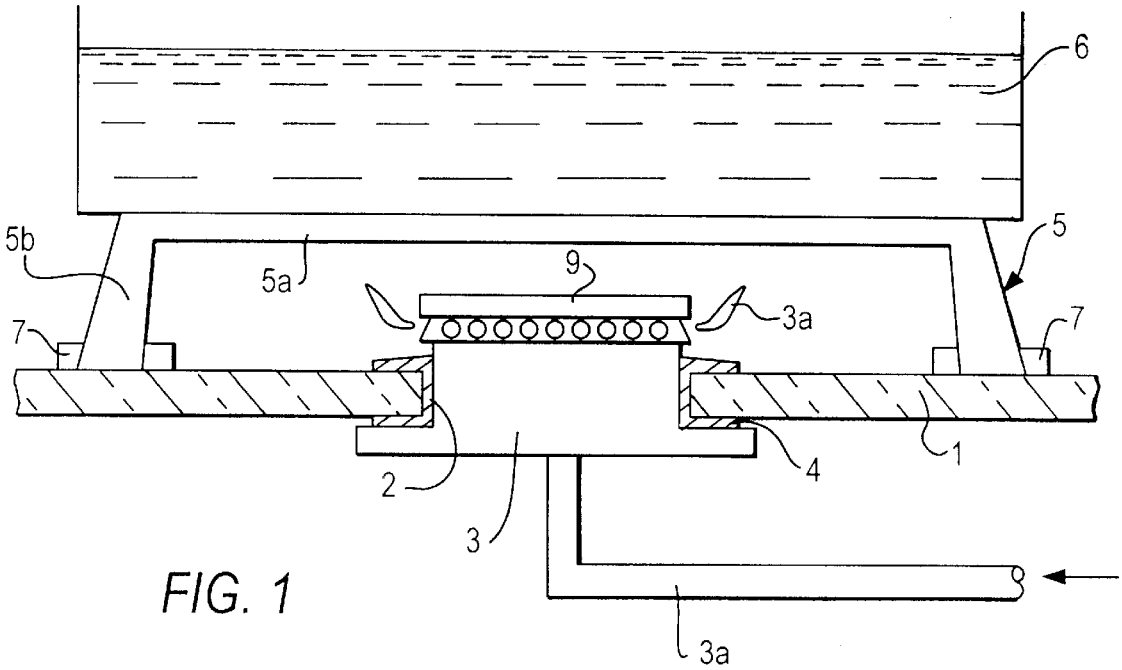
FIG. 1
FIG. 2
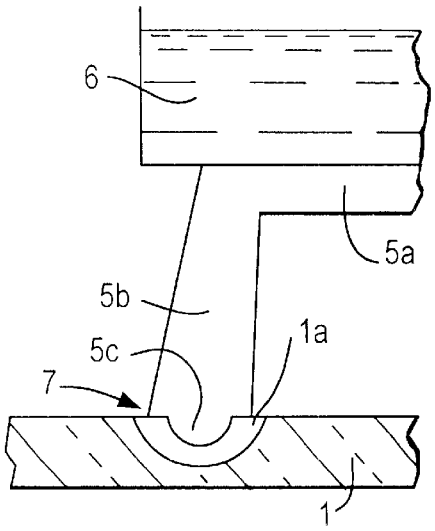
FIG. 3
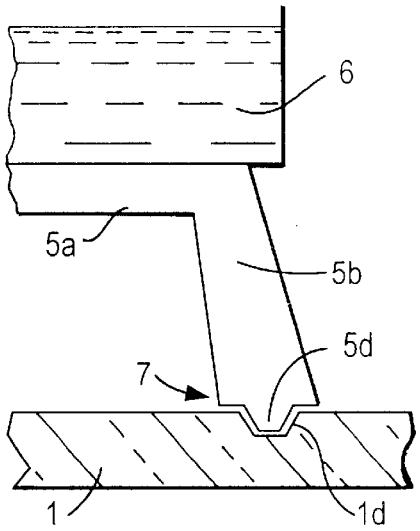

COOKING APPARATUS WITH A GAS BURNER AND A DEVICE FOR HOLDING A COOKING VESSEL SUPPORT OVER THE GAS BURNER

CROSS-REFERENCE

This is a divisional of Ser. No. 09/460,694, filed Dec. 14, 1999 now allowed.

BACKGROUND OF THE INVENTION

The present invention relates to a cooking apparatus with a glass/glass-ceramic panel, which has at least one cooking area and a gas burner, which produces an open flame. The cooking apparatus has a concentric mechanically fixed cooking vessel support concentric to the gas burner that has feet and a resting or bearing surface on which a cooking vessel is supported or rests.

Cooking arrangements including glass-ceramic panels providing cooking surfaces and cooking areas, which are heated electrically, have been known for more than two decades. These glass-ceramic cooking areas are valued primarily because of their pleasing appearance, their plane surfaces and easy cleaning. Because of the definite and valued advantages that glass-ceramic materials provided as cooking surface materials, these materials have now been used for several years in gas cooking units or cooking units with electrically heated cooking zones in combination with gas burners, the so-called mixed units.

Two types of gas cooking units have been built. In a first type a gas burner is provided which is arranged under the cooking area of a closed glass-ceramic panel. This sort of gas cooking unit is, for example, described in DE 43 26 945 C2.

In a second type of cooking unit of this kind conventional atmospheric gas burners, i.e. those with an open flame, are inserted through respective openings in the glass-ceramic panel.

For example, a cooking unit with a gas burner of this latter type with an open flame, as it is described in DE 195 05 469 C1, forms the starting point for the present invention, i.e. the present invention is an improved cooking unit of this type.

The previously described cooking apparatus with a glass/glass-ceramic panel, which has at least one cooking area with a gas burner with an open flame, requires a vessel support. This vessel support has a standing or resting surface for a cooking vessel with feet attached to it and is placed on the glass/glass-ceramic panel. This cooking vessel support must be arranged so that it is concentric to the gas burner and fixed in position, so that the energy transfer from the burner to the cooking vessel is optimum.

The attachment and centering of the vessel support in known cooking units with glass-ceramic cooking surfaces and gas burners integrated in them occurs by means of the cover for the atmospheric gas burner. Alternatively it occurs by means of impressions in an adapter plate between the gas burner and the glass-ceramic panel.

It is also known to center the vessel support by impressions in the cooking surface frame in a currently marketed product. The impressions must be formed so that the cooking vessel support is definitely centered in its resting position.

The disadvantage of the currently marketed embodiments of the device for fixing the cooking vessel support in position involves the expensive form for the gas burner, in cases in which it is used as the centering means. In cases in which an adapter plate is used or with a cooking area frame having a complicated form, these components are disadvantageously expensive and prevent a flexible interchangeable parts system for part replacement from being developed. Furthermore parts with impressions are difficult to clean.

SUMMARY OF THE INVENTION

It is an object of the present invention to provide a cooking apparatus with a cooking vessel support of the above-described kind, which has means for fixing the cooking vessel support in an advantageously centered position over the gas burner, that is economical, flexible to manufacture and easy to clean.

These objects, and others which will be made more apparent hereinafter, are attained in a cooking apparatus comprising a glass panel or a glass-ceramic panel, which as at least one cooking area, a gas burner providing an open flame, a cooking vessel support including feet and a resting surface for a cooking vessel placed on the cooking vessel support.

According to the invention the glass/glass-ceramic panel has a foot holding device to holding the cooking vessel support in a fixed position on it. This foot holding device advantageously comprises a plurality of foot holders for the respective feet of the cooking vessel support.

In contrast to the state of the art according to the present invention fixing points for the feet of the cooking vessel support are definitely located immediately on the cooking surface, the glass/glass-ceramic panel. The foot holders are economical, flexible to manufacture and easy to clean.

The cooking vessel support is easily fixed by the foot holding device when the foot holders include depressed regions formed in the glass/glass-ceramic panel, which are adapted to the shape of the feet ends. A satisfactory controllable technique for forming the depressed regions in the glass/glass-ceramic panel has been developed in the meantime. In this method the foot holders formed by partially depressed or sunken potions in the glass/glass-ceramic panel can be directly formed during the manufacture of the glass/glass-ceramic panel or in a separate manufacturing step.

According to a preferred embodiment of the invention the cooking unit can also be made with foot holders formed by grinding the depressed regions out of the glass/glass-ceramic panel, so that they fit the shape of the respective foot ends.

The grinding out can occur after the ceramicizing of glass-ceramic panel or already in the non-ceramicized green-glass state by means of known grinding methods.

The foot holders themselves need not be made directly in the material of the glass/glass-ceramic panel. Various embodiments of the invention can also be designed so that the foot holders are formed by respective foot holding parts mounted on the glass/glass-ceramic panel, provided with cavities or recesses for the receiving and holding the foot ends fixed in position on the glass/glass-ceramic panel. These foot holding parts can be made comparatively easily and can be formed in a variety of different ways and mounted on the glass/glass-ceramic panel.

According to a first embodiment of the invention the foot holding parts are each formed in one piece and can be mounted as a whole on the glass/glass-ceramic panel. These foot-holding devices must then be cleaned "in situ", i.e. in the attached or mounted state.

This latter difficulty may be avoided when the individual foot holding device or holder is formed in two-parts, with a base part, which is attached to the glass/glass-ceramic panel, and with an upper part that is removable from the base part.

The removable upper part of the foot holder can then be separated from the cooking unit and cleaned, e.g. in a washing machine.

A series of possibilities are available to one skilled in the art for mounting or attaching these foot holders. In embodiments of the invention in which the foot holder is in one piece, the foot holder as a whole may be glued to the glass/glass-ceramic panel. In other embodiments in which the foot holder is formed in two parts, the side of the base part facing the cooking surface may be glued to the glass/glass-ceramic panel. Suitable glue (for example, high temperature silicone glue) with lasting adhesive properties is available to one skilled in the arts.

According to another embodiment of the invention the arrangement is designed so that each foot holder has an extension on its side that is attached to the glass/glass-ceramic panel. This extension or protrusion is received and mechanically fixed in a suitable passage in the glass/glass-ceramic panel.

When each foot holder is attached to the glass/glass-ceramic panel in this manner the foot holder may be taken out of the glass/glass-ceramic panel for the purpose of cleaning and replacement.

This is particularly easy when the extension is provided with a thread for screwing into a sleeve in a passage or hole provided in the glass/glass-ceramic panel.

Alternatively to the screw connection the projection of the foot holder part can also be clamped in a suitable passage in the glass-ceramic panel by means of a spring device. It is particularly advantageous when the projection has a structure, preferably grooved or rifled, adapted for insertion into a sleeve in the passage.

The foot holder according to the invention described up to now has a depression or cavity, in which a foot of the cooking vessel support rests. These depressions or cavities, as explained previously, can be formed by sunken or ground out regions of the glass/glass-ceramic panel, or can be formed by suitable recesses or depressions in a separate molded part or stud, which is attached to the glass/glass-ceramic panel.

According to another alternative embodiment of the invention raised regions of the glass/glass-ceramic panel form the respective foot holders.

The top of these raised regions can be formed in a variety of ways.

Advantageously the raised regions can be already formed during the manufacture of the glass/glass-ceramic panel. That is according to a further embodiment of the invention they can be formed immediately in the material of the glass/glass-ceramic panel by providing impressions or pushed-up regions in the glass/glass-ceramic panel that are raised on or elevated from the cooking surface side of the glass/glass-ceramic panel. Alternatively the raised regions are formed by respective protruding enlarged or thickened portions of the glass/glass ceramic panel that project from the cooking surface.

The raised regions of the glass/glass-ceramic panel can be formed either as resting points in the vicinity of the cooking vessel support feet or alternatively as a rotationally symmetric ring around the gas burner. In this latter embodiment the circumferential ring can hold back cooking material that overflows in the burner region and prevent its flow off the entire cooking surface.

According to a preferred embodiment of the invention the cooking apparatus is formed so that the resting surfaces of the cooking vessel support feet are adjusted to fit the shapes of the raised regions.

For positioning of the cooking vessel support feet according to a first variant of the invention the cooking unit is formed so that respective pins provided in the cooking vessel support feet engage in corresponding passages or recesses provided in the raised regions. Additional features are set forth in the appended dependent claims.

BRIEF DESCRIPTION OF THE DRAWING

The objects, features and advantages of the invention will now be illustrated in more detail with the aid of the following description of the preferred embodiments, with reference to the accompanying figures in which:

FIG. 1 is a diagrammatic cross-sectional view of a gas burner area witha cooking vessel support which is received with its feet by locally fixed foot holders formed on the glass-ceramic plate according to the invention;

FIG. 2 is a detailed cutaway cross-sectional view of another embodiment of the foot holder shown in FIG. 1 with a protruding region on a foot end engaged in a correspondingly shaped annular groove provided in the glass-ceramic panel;

FIG. 3 is a detailed cutaway cross-sectional view of a further embodiment of the foot holder shown in FIG. 1 with a complementary foot end with a protruding region engaged in a ground out or impressed region provided in the glass-ceramic panel;

DESCRIPTION OF THE PREFERRED EMBODIMENTS

Figure 4:
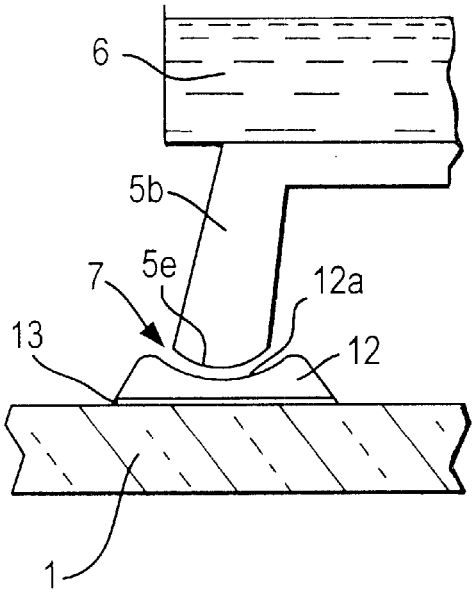
FIG. 4 is a detailed cutaway cross-sectional view of an additional embodiment of the foot holder as shown in FIG. 1 including a separate, one-piece stud-shaped foot holder part, which is glued to the glass-ceramic panel.

FIG. 1 shows a gas burner area of a cooking unit with a glass-ceramic panel 1 providing a cooking surface. The glass-ceramic panel 1 is provided with an opening 2, in which an atmospheric burner 3 with symbolically indicated flames 3*a* of a conventional type is received and is bordered with a circular collar 4.

A conventional cooking vessel support or pot holder 5 provided with a standing or resting surface 5*a* and feet 5*b* is associated with a gas burner 3, on which the respective schematically illustrated cooking vessel 6, a pot, a pan or the like, stands.

FIG. 1 only shows a single gas burner area of a cooking apparatus, but it is understood that the cooking apparatus can have several such gas burner areas. It can also be a so-called mixed cooking unit, with a combination of at least one electrically heated cooking zone and at least one gas burner area according to FIG. 1.

The same goes for the embodiments shown in the following figures.

A pure gas, which is mixed later with so-called primary air or already a mixture (pre-mix) comprising gas and primary air is fed via a feed pipe 3*a* to the burner 3 according to the form of the burner. This gas mixture burns in the space 9 between the glass-ceramic panel 1 and the bottom of the cooking vessel. The exhaust gas flows away to the outside between the legs of the cooking vessel support or pot holder 5.

As shown in FIG. 1, the cooking vessel support 5 stands directly on the glass-ceramic panel 1. In order to guarantee an optimum combustion or energy transfer, it must be fixed in position relative to the gas burner 3 by foot holders 7, or a foot holding device comprising the foot holders 7, indicated in principle in FIG. 1. These foot holders are fixed in position on the glass-ceramic panel 1 and hold the feet 5*b* of the cooking vessel support 5 fixed.

Different possibilities for embodiments of the foot holders 7, or foot holding device, for holding the cooking vessel support 5 in a fixed centered position are described with the aid of the following figures. These figures show respective detailed or magnified cutaway views of various possible forms of a foot 5*b* of the cooking vessel support 5 of FIG. 1.

FIG. 2 shows one embodiment, in which the foot holder 7 of FIG. 1 is formed by a sunken or depressed region 1*a* in the glass-ceramic panel 1 and a complementary protruding region 5*c* on the end of the foot 5*b*. The shape of the depression and the shape of the protruding region are different in different embodiments. The shape of the sunken or depressed region can either converge toward a peak in the vicinity of the foot as in FIG. 3 or can be a rotationally symmetric depressed region 1*a*. In the first case shown in FIG. 3 it is an individual dented portion, in the other embodiment shown in FIG. 2, an annular groove. The depression can also extend through the entire thickness of the panel 1, i.e. the panel 1 then has a uniform thickness in the vicinity of the depression. In this latter embodiment this region would be immediately punched out during manufacture of the glass ceramic panel. In other embodiments the shaping would occur by grinding it out or by similar methods.

FIG. 3 shows an embodiment in which the foot holder 7 is formed by a ground out or impressed depression or recess 1*b* in the glass-ceramic panel 1 and a protruding region 5*d* of the foot 5*b* of the vessel support. The protruding region 5*d* is formed with a shape that complements or fits in the ground out depression or recess 1.

Different shapes are possible for the contour of the ground out depression or recess 1*b* and the complementary protruding region 5*d*. In this embodiment also the impressed depression can come to a peak like a dent.

While the foot holders 7 in the above embodiments according to FIGS. 2 and 3 are formed directly in the glass-ceramic panel 1, the foot holders 7 in the following embodiments comprise at least one foot holder part that is connected mechanically in different ways with the glass-ceramic panel.

The embodiment according to FIG. 4 has a one-piece foot holder part 12 with a trough-shaped recess 12*a* in which the foot end 5*e* which has a shape that complements that of the trough-shaped recess is engaged or held. In this embodiment the foot holder part or stud 12 is glued to the glass-ceramic panel 1 by the adhesive or glue bead 13.

Figure 5:
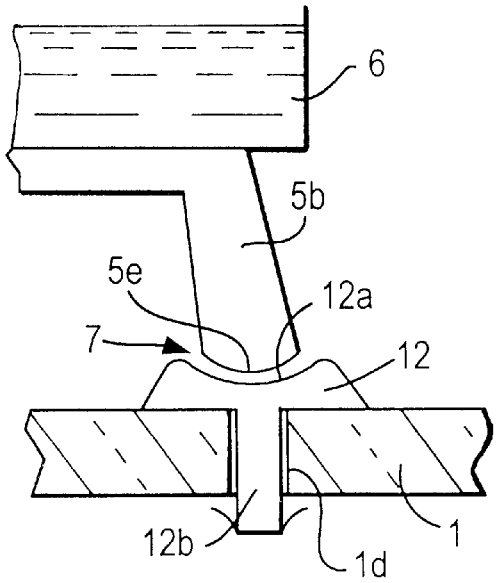
FIG. 5 is a detailed cutaway cross-sectional view of a further embodiment of the foot holder as shown in FIG. 4 with a one-piece stud-shaped foot holder device having an extension with which it is clamped in a passage in the glass-ceramic panel.

In the alternative embodiment shown in FIG. 5 the foot holder stud or part 12 is not glued to the glass-ceramic panel 1, but has an extension 12*b*, which is received in a passage 1*c* provided in the glass-ceramic panel 1. In the simplest case the extension 12*b* is attached to the other side of the glass-ceramic panel with a tension spring washer or plate. However it can also be provided with a thread and can thus be screwed into the underside. Similarly the extension can be glued to the glass-ceramic panel with a resilient glue or adhesive.

Figure 6:
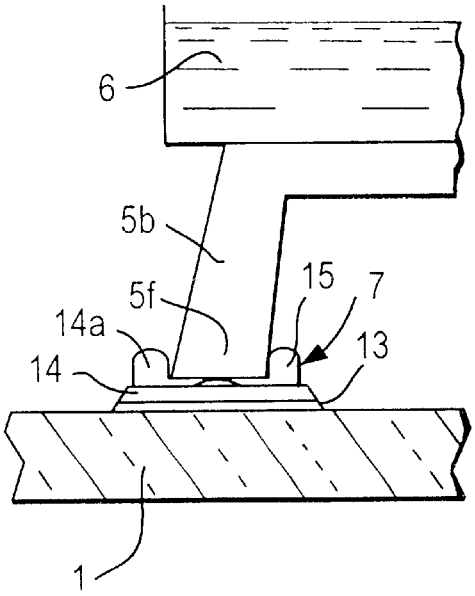
FIG. 6 is a detailed cutaway cross-sectional view of another embodiment of the foot holder shown in FIG. 4, however with a two-part structure with a removable upper part.
Figure 7:
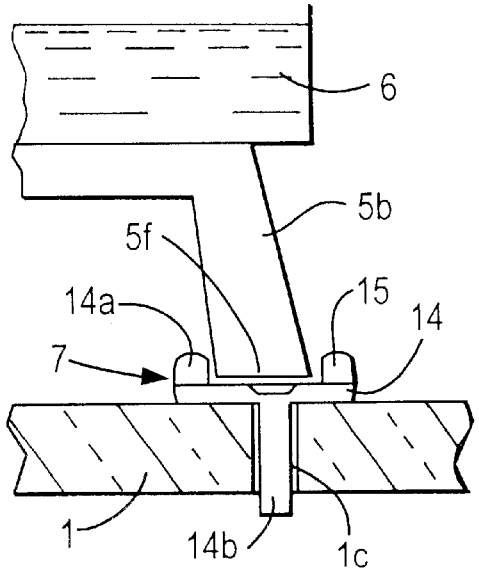
FIG. 7 is a detailed cutaway cross-sectional view of a further embodiment of the foot holder shown in FIG. 5, but with a two-part structure as shown in FIG. 6.

In the embodiments shown in FIGS. 6 and 7 the foot holder 7 is formed with two parts. One part is a base part 14. In the embodiment of FIG. 6 the base part 14 is glued to the glass-ceramic panel 1 by the glue bead 13, as in the embodiment of FIG. 4. Alternatively, in the embodiment shown in FIG. 7 the base part 14 is mechanically fixed in a passage 1*c* provided in the glass-ceramic panel 1, in a manner similar to the embodiment of FIG. 5 by insertion of an extension 14*b* of the base part 14 in the passage 1*c*. The foot holder 7 also has an upper part 15, which is attached to the base part 14 in a releasable manner by a form-locking connection.

The upper part 15 is provided with a cavity 14*a* having a raised peripheral lip in this embodiment, in which the corresponding complementary end 5*f* of the foot 5*b* fits.

The embodiments of the foot holders 7 described previously with the help of FIGS. 1 to 7 retain the cooking vessel supported in a centered fixed position over the gas burner 3 and are based on the principle that the feet ends rest in depressions or recesses.

Additional embodiments of the foot holders 7 are shown in FIGS. 8 to 11, which are based on the principle that the foot holders are formed by raised regions or protruding regions of the glass/glass-ceramic panel 1.

Figure 8:
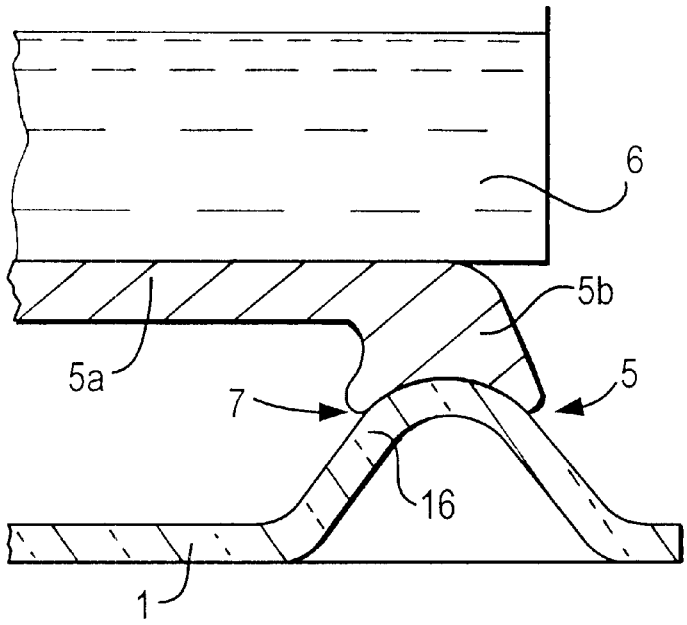
FIG. 8 is a detailed cutaway cross-sectional view of an alternative embodiment to that of FIG. 1, in which a raised region of the glass-ceramic panel forming the foot holder engages in corresponding concave region provided in the respective foot end.

FIG. 8 shows an embodiment with a raised or protruding region that is formed by a protruding or raised portion 16 of the glass-ceramic panel 1, which is raised from the remaining part of the cooking surface. This protruding region 16 can extend circumferentially around the gas burner 3 thus forming an annular wall or can be dome-shaped and converge toward a peak. The foot end 5*b* is concave and shaped to partially enclosed or surround the complementarily shaped protruding region 16. The cooking vessel support 5 is held fixed or positioned in this way.

Figure 9:
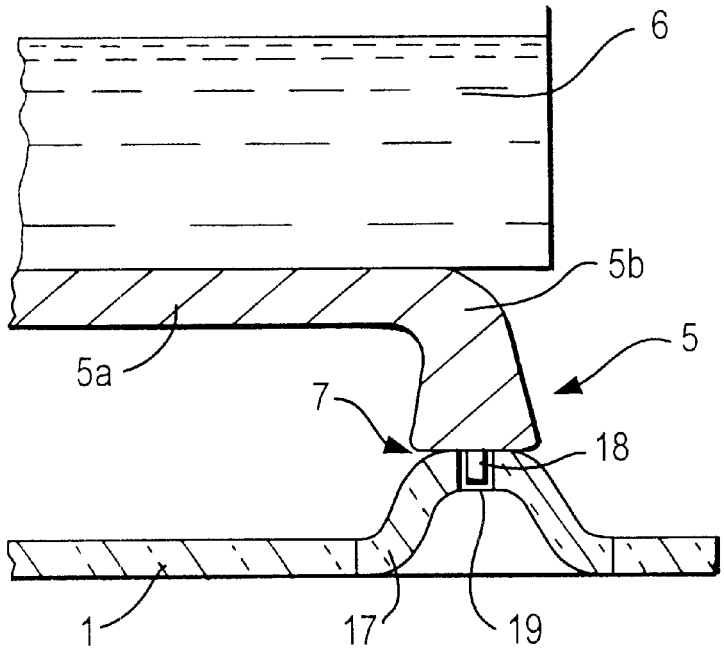
FIG. 9 is a detailed cross-sectional view of an embodiment similar to that of FIG. 8, but with a flat surface on the raised region of the glass-ceramic panel and a pin extending from the foot end engaged in a hole in the flat surface.

In the embodiment shown in FIG. 9 a raised region 17 similar to that in FIG. 8 is formed directly on the glass-ceramic panel 1. However the raised region 17 is flat on its upper side in contrast to the protruding region 16 shown in FIG. 8, similar to the foot end 5*b* of the cooking vessel support. In order to obtain a reliable and secure positioning and fixing of the cooking vessel support a pin 18 is formed on the foot end 5*b* and a passage 19 is provided in a flat portion on the raised region 17 to receive the pin 18. In the embodiment shown in FIG. 9 the raised region 17 can converge toward a peak or be a circumferential annular wall.

Figure 10:
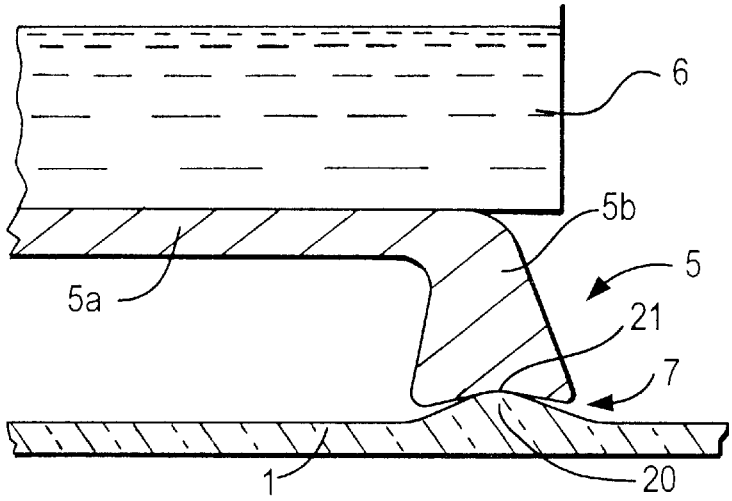
FIG. 10 is a detailed cross-sectional view of another embodiment similar to that of FIG. 8, but with an enlarged or thickened section forming the raised region of the glass-ceramic panel.

In the embodiment shown in FIG. 10 the raised or protruding region is formed by a thickened portion 20 of the glass-ceramic panel 1, i.e. a portion of the glass-ceramic panel that is thicker than its remaining portion. In contrast in the protruding region 16 and raised region 17 provided in the embodiments shown in FIGS. 8 and 9 the glass-ceramic panel has the same thickness in the raised or protruding regions as in its remaining portion. The foot end 5*b* has a complementary indentation for positioning the cooking vessel support 5. Also in this embodiment the thickened portion 20 can converge toward a peak or be a circumferential annular wall.

Figure 11:
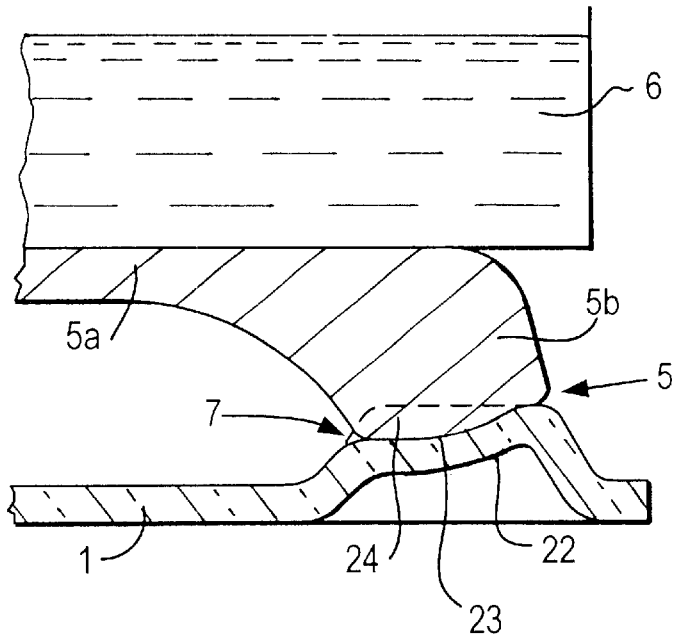
FIG. 11 is a detailed cross-sectional view of a further embodiment similar to that of FIG. 8 with a raised region in the glass-ceramic panel, which receives a complementarily shaped foot end for positioning the foot end on the raised region.
Figure 12:
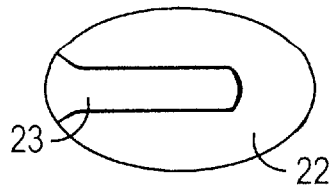
FIG. 12 is a detailed plan view of the raised region of the embodiment shown in FIG. 11, showing the elongated hole in which the nose-shaped element of the foot end engages.

In the embodiment shown in FIGS. 11 and 12 the foot holder 7 includes a raised region 22 provided with an elongated hole 23 and a nose-shaped element 24, which protrudes from the foot end 5*b* and has a complementary shape designed to fit in the elongated hole 23. This nose-shaped element 24 has the same function as the pin 18 in the embodiment of FIG. 9, i.e. fixing the cooking vessel support or pot holder in position. The raised region 22 as in the other embodiments can converge on a peak or be a circumferential annular wall.

In all the embodiments in which the raised region, thickened portion or protruding region forms a circumferential annular wall possible overflowing cooking materials are held back in the burner region and prevented from spreading beyond the cooking surface.

While the foot holders according to FIGS. 8 to 11 are each formed directly on the glass-ceramic panel 1, i.e. in one piece, also separate foot holder parts can be provided, which are mechanically connected in different ways with the glass-ceramic panel, according to the embodiments of FIGS. 4 to 7.

The disclosure in German Patent Application 198 58 019.3-16 of Dec. 16, 1998 and in German Patent Application 199 05 670.6 of Feb. 11, 1999 is incorporated here by reference. These German Patent Applications describe the invention described hereinabove and claimed in the claims appended hereinbelow and provide the basis for a claim of priority for the instant invention under 35 U.S.C. 119.

While the invention has been illustrated and described as embodied in a cooking apparatus with a gas burner and a device for holding a cooking vessel support over it, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A cooking apparatus comprising a glass panel or a glass-ceramic panel (1) having at least one cooking area;

a gas burner (3) comprising means for producing an open flame (3*a*);

a cooking vessel support (5) including feet (5*b*) and a resting surface for a cooking vessel (6) placed on the cooking vessel support (5); and a foot holding device for holding said cooking vessel support (5) in a fixed position over the gas burner (3);

wherein said foot holding device comprises a plurality of raised or protruding regions (16,17,20,22) of said glass pane or glass-ceramic panel (1).

2. The cooking apparatus as defined in claim 1, wherein said raised or protruding regions (16,17,22) are formed by respective raised sections of said glass panel or said glass-ceramic panel (1) and said raised sections are elevated from a remaining portion of said glass panel or said glass-ceramic panel (1).

3. The cooking apparatus as defined in claim 1, wherein said raised or protruding regions are formed by thickened portions (20) of the glass panel or glass-ceramic panel (1).

4. The cooking apparatus as defined in claim 1, wherein said raised or protruding regions are formed by a plurality of molded parts extending out from said glass panel or glass-ceramic panel and said molded parts are fixed to said glass panel or said glass-ceramic panel.

5. A cooking apparatus comprising a glass panel or a glass-ceramic panel (1) having at least one cooking area;

a gas burner (3) comprising means for producing an open flame (3*a*);

a cooking vessel support (5) including feet (5*b*) and a resting surface for a cooking vessel (6) placed on the cooking vessel support (5); and a foot holding device for holding said cooking vessel support (5) in a fixed position over the gas burner (3);

wherein said foot holding device comprises a plurality of raised or protruding regions of said glass pane or glass-ceramic panel (1);

wherein said feet (5*b*) of said cooking vessel support (5) have respective bearing surfaces and said respective bearing surfaces are formed or shaped to fit together with said raised or protruding regions, whereby said cooking vessel support (5) is held in said fixed position and centered over said gas burner (3).

6. The cooking apparatus as defined in claim 5, wherein said feet (5*b*) have respective pins (18) protruding from said bearing surfaces and said raised regions (17) have corresponding passages (19) for receipt of said respective pins (18).

7. The cooking apparatus as defined in claim 5, wherein said feet (5*b*) have respective nose-shaped elements (24) and said raised regions (22) have corresponding elongated holes (23) having a shape complementary to said respective nose-shaped elements (24), whereby said nose-shaped elements (24) fit into said elongated holes and said cooking vessel support (5) is in said fixed position and centered over said gas burner (3).

* * * * *